US007987023B2

(12) United States Patent
Bush et al.

(10) Patent No.: US 7,987,023 B2
(45) Date of Patent: Jul. 26, 2011

(54) HUMIDITY CONTROL FOR MULTIPLE UNIT A/C SYSTEM INSTALLATIONS

(75) Inventors: Terry D. Bush, Westerville, OH (US); John E. Saunders, Grove City, OH (US); John F. Christensen, Lewis Center, OH (US)

(73) Assignee: Liebert Corporation, Columbus, OH (US)

( * ) Notice: Subject to any disclaimer, the term of this patent is extended or adjusted under 35 U.S.C. 154(b) by 394 days.

(21) Appl. No.: 12/388,224

(22) Filed: Feb. 18, 2009

(65) Prior Publication Data

US 2009/0210095 A1 Aug. 20, 2009

Related U.S. Application Data

(60) Provisional application No. 61/030,018, filed on Feb. 20, 2008.

(51) Int. Cl.
*G06F 19/00* (2006.01)
*G05B 21/00* (2006.01)

(52) U.S. Cl. ..... 700/277; 700/276

(58) Field of Classification Search ..... 700/276, 700/277; 62/176.1

See application file for complete search history.

(56) References Cited

U.S. PATENT DOCUMENTS

| | | | | |
|---|---|---|---|---|
| 3,788,386 | A | 1/1974 | Demaray | |
| 4,013,118 | A | 3/1977 | Zimmer et al. | |
| 4,018,584 | A | 4/1977 | Mullen | |
| 4,479,604 | A | 10/1984 | Didner | |
| 4,830,095 | A | 5/1989 | Friend | |
| 4,984,433 | A | 1/1991 | Worthington | |
| 5,195,329 | A * | 3/1993 | Lewis et al. | 62/117 |
| 5,261,596 | A | 11/1993 | Tachibana et al. | |
| 5,495,887 | A | 3/1996 | Kathnelson et al. | |
| 5,511,006 | A | 4/1996 | Tachibana et al. | |
| 5,520,328 | A | 5/1996 | Bujak, Jr. | |
| 6,070,110 | A * | 5/2000 | Shah et al. | 700/278 |
| 6,790,420 | B2 | 9/2004 | Breen et al. | |
| 6,879,881 | B1 | 4/2005 | Attridge, Jr. | |
| 6,922,613 | B2 | 7/2005 | Park et al. | |

(Continued)

FOREIGN PATENT DOCUMENTS

EP 0 632 234 6/1994

(Continued)

OTHER PUBLICATIONS

"Dehumidification and Cooling Loads From Ventilation Air", Harriman III et al, American Society of Heating, Refridgeration & Air Conditioning Engineers, Inc, ASHRAE Journal; Nov. 1997, pp. 37-45.*

(Continued)

*Primary Examiner* — Michael D Masinick

(74) *Attorney, Agent, or Firm* — Harness, Dickey & Pierce, P.L.C.

(57) ABSTRACT

An air conditioning (A/C) system that may have a plurality of air conditioning units disposed in different zones of an area that each operate to cool the different zones, a humidity sensor for sensing the humidity in the area, and a controller. The controller may be adapted to analyze a sensible heat load being experienced by each of the air conditioning units and to control a latent heat removal being performed by each air conditioning unit such that a percentage of latent heat removal performed by each air conditioning unit does not exceed a percentage of sensible heat removal being performed by each air conditioning unit.

21 Claims, 5 Drawing Sheets

U.S. PATENT DOCUMENTS

| | | | | |
|---|---|---|---|---|
| 6,996,999 | B2 * | 2/2006 | Wacker | 62/158 |
| 7,020,540 | B2 | 3/2006 | Linehan et al. | |
| 7,036,559 | B2 * | 5/2006 | Stanimirovic | 165/11.1 |
| 7,354,005 | B2 | 4/2008 | Carey et al. | |
| 2005/0016189 | A1 * | 1/2005 | Wacker | 62/93 |
| 2005/0023362 | A1 | 2/2005 | Wacker | |
| 2005/0087616 | A1 | 4/2005 | Attridge | |
| 2006/0032929 | A1 | 2/2006 | Hwang et al. | |
| 2008/0041076 | A1 | 2/2008 | Tutunoglu et al. | |
| 2008/0116289 | A1 | 5/2008 | Lochtefeld | |

FOREIGN PATENT DOCUMENTS

| | | |
|---|---|---|
| JP | 10-259944 | 9/1998 |
| JP | 2004-60978 | 2/2004 |
| JP | 2007-147203 | 6/2007 |

OTHER PUBLICATIONS

"Optimization of air-conditioning system operating strategies for hot and humid climates", Huh et al, ScienceDirect, Oct. 30, 2007.*

* cited by examiner

PRIOR
ART

PRIOR
ART

HUMIDITY CONTROL FOR MULTIPLE UNIT A/C SYSTEM INSTALLATIONS

CROSS REFERENCE TO RELATED APPLICATIONS

The present application claims priority from U.S. provisional application Ser. No. 61/030,018, filed Feb. 20, 2008, and which is hereby incorporated by reference into the present application.

FIELD

The present disclosure relates to air conditioning systems, and more particularly, rooms where multiple unit air conditioning system installations are used for cooling.

BACKGROUND

The statements in this section merely provide background information related to the present disclosure and may not constitute prior art.

"Sensible cooling," as that term is used in the field of heating/ventilation/air-conditioning (HVAC) is the removal of thermal heat from the air within an area, such as a room. "Sensible heat" load is thus heat load due to thermal heat in the air—i.e., the temperature at which the air is at. "Latent cooling" is the removal of moisture or humidity from the air. "Latent heat" load is thus the heat load due to moisture or humidity in the air.

With reference to FIG. 1, in a large room 10 where multiple air conditioning (A/C) units 12, 14 and 16 are used to cool the room, sensible heat flow (shown by heavy dashed lines) can tend to form into "zones" 18, 20 and 22 (indicated by heavy dotted lines 24). Although some heat can flow between zones (shown by light dashed lines 26), the majority of heat flow, which is controlled by convection, often stays within the zone determined by the air flow of the individual A/C units. Depending on the distribution of heat load in the room 10, this can cause an imbalancing of heat load between the A/C units 12, 14 and 16, with each A/C unit essentially assuming only the load in its own zone.

With reference to FIG. 2, latent heat (moisture) flow does not create this same "zoning" effect as sensible heat. Latent heat flow, although it can be partially affected by the air flow of the A/C units, will normally distribute evenly within the room space as indicated by dashed arrow 28. This is due to the effect of vapor pressure created by the moisture in the air. This vapor pressure will force the moisture to distribute evenly within the room 10 independent of the air flow of the A/C units 12, 14 and 16.

Due to the "zoning" effect of the sensible (or thermal) heat, the temperature control for the individual A/C units 12, 14 and 16 must be allowed to operate independently, with each unit providing the heat removal needed for its zone 18, 20 and 22 respectively. This is needed to ensure that proper temperature control maintained throughout the room 10. However, the humidity control for the individual A/C units 12, 14 and 16 is not restricted by this effect. In fact, since the moisture flows evenly within the room 10, any one A/C unit 12, 14 or 16 (or set of A/C units) can provide the total latent heat removal for the entire room and still maintain proper humidity control throughout the room.

FIG. 3 illustrates the standard method of performing temperature and humidity control. Due to thermal "zoning", the sensible heat loads for each A/C unit 12, 14 and 16 are not equal. However, since moisture is evenly distributed throughout the room 10, the latent heat loads for each A/C unit 12, 14 and 16 are equal. Since moisture is removed from the space by performing cooling, any A/C unit 12, 14 or 16 that does not have adequate sensible load to cause the A/C unit to be cooling at a level necessary for the existing latent heat removal must provide more cooling than is needed for the sensible heat removal. In order to maintain temperature control, this necessitates the operation of heating (typically electric heating elements) in order to balance the extra cooling needed for humidity control.

In the example of FIG. 3, A/C unit 12 and A/C unit 16 are operating in an efficient mode since their respective sensible heat loads are larger than the latent heat load in the room 10. However, A/C unit 14 is not operating efficiently. It must operate at least at 50% sensible heat load in order to remove its share of the latent heat load in the room. But since its sensible heat load is only 20%, it must provide 30% heating to maintain proper temperature control in its zone.

SUMMARY

In one aspect the present disclosure relates to an air conditioning (A/C) system. The air conditioning system may comprise a plurality of air conditioning units disposed in different zones of an area that each operate to cool the different zones, a humidity sensor for sensing the humidity in the area, and a controller. The controller may be adapted to analyze a sensible heat load being experienced by each of the air conditioning units and to control a latent heat removal being performed by each air conditioning unit such that a percentage of latent heat removal performed by each air conditioning unit does not exceed a percentage of sensible heat removal being performed by each air conditioning unit.

In another aspect the present disclosure relates to an air conditioning system that may comprise a first air conditioning unit disposed in a first zone of an area and a second air conditioning unit disposed in a second zone of the area, where the second zone is different from the first zone. The air conditioning system may also include a first system for sensing temperature in the first zone; a second system for sensing temperature in the second zone; a humidity sensing system for sensing a humidity in the area; and a controller for receiving information concerning a sensible heat load and a latent heat load being handled by each of the first and second air conditioning units. The controller may operate to determine which one of the air conditioning units is able to accommodate additional latent heat removal without exceeding a percentage of sensible heat removal being performed by each air conditioning unit. The controller may control the one of the air conditioning units to provide a percentage of increased latent heat removal without causing a total percentage of latent heat removal loading on the one air conditioning unit to exceed the percentage of sensible heat removal being performed by the one air conditioning unit.

In another aspect the present disclosure relates to an air conditioning system that may include a first air conditioning unit disposed in a first zone of an area; a second air conditioning unit disposed in a second zone of the area, where the second zone is different from the first zone, a third air conditioning unit disposed in a third zone of the area, where the third zone is different from the first and second zones; a first system for sensing temperature in the first zone; a second system for sensing temperature in the second zone; a third system for sensing temperature in the third zone; a humidity sensing system for sensing a humidity in the area; and a controller in communication with each of the first, second and third air conditioning units. The controller may be adapted to monitor a sensible heat removal load and a latent heat removal load being experienced by each air conditioning unit. The controller may further be adapted to determine which one or more of the air conditioning units is able to accommodate a portion of an additional latent heat removal load without having its percentage of total latent heat removal exceed a percentage of sensible heat removal being performed by each air conditioning unit, and distributing the additional latent heat load to selected ones of the air conditioning units in accordance with available latent heat cooling capacity of selected ones of the air conditioning units.

In another aspect the present disclosure relates to a method for controlling temperature and humidity in an area having a plurality of zones. The method may comprise: disposing an air conditioning unit in each of the zones; sensing a temperature in each of the zones; sensing a humidity in the area; determining a sensible heat removal load being experienced by each air conditioning unit; and balancing a removal of latent heat within the area by the air conditioning units. Balancing may be accomplished such that a percentage of latent heat removal load being experienced by each air conditioning unit does not exceed a percentage of its sensible heat removal load.

DETAILED DESCRIPTION

Figure 1:
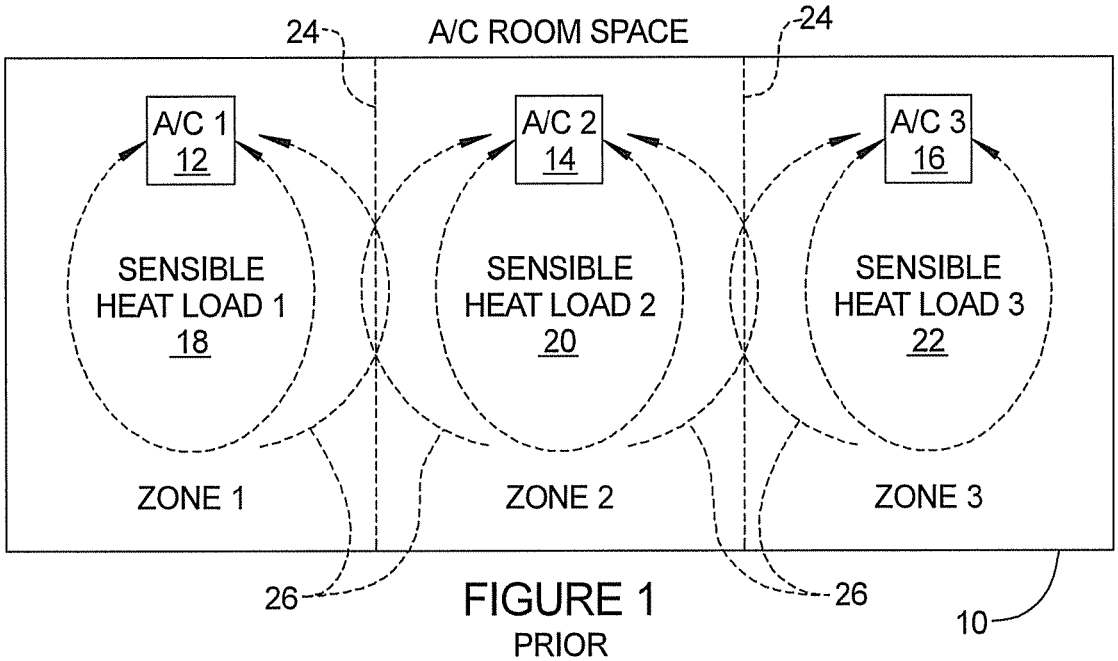
FIG. 1 is a block diagram of a prior art air conditioning system illustrating three independent A/C units located in three zones within a room, and further illustrating how a majority of sensible heat flow will flow within a given zone, while a minority will flow between adjacent zones.
Figure 2:
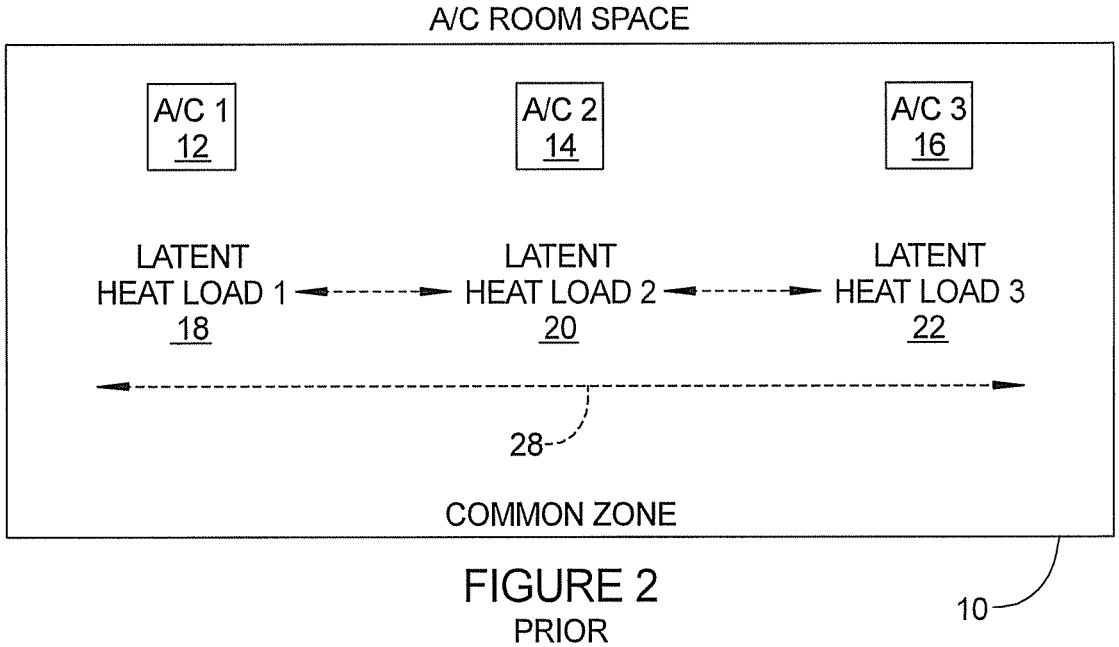
FIG. 2 is a block diagram of a prior art air conditioning system indicating how latent heat flow is not contained within distinct zones of the room, but rather will normally distribute evenly throughout the entire room.
Figure 3:
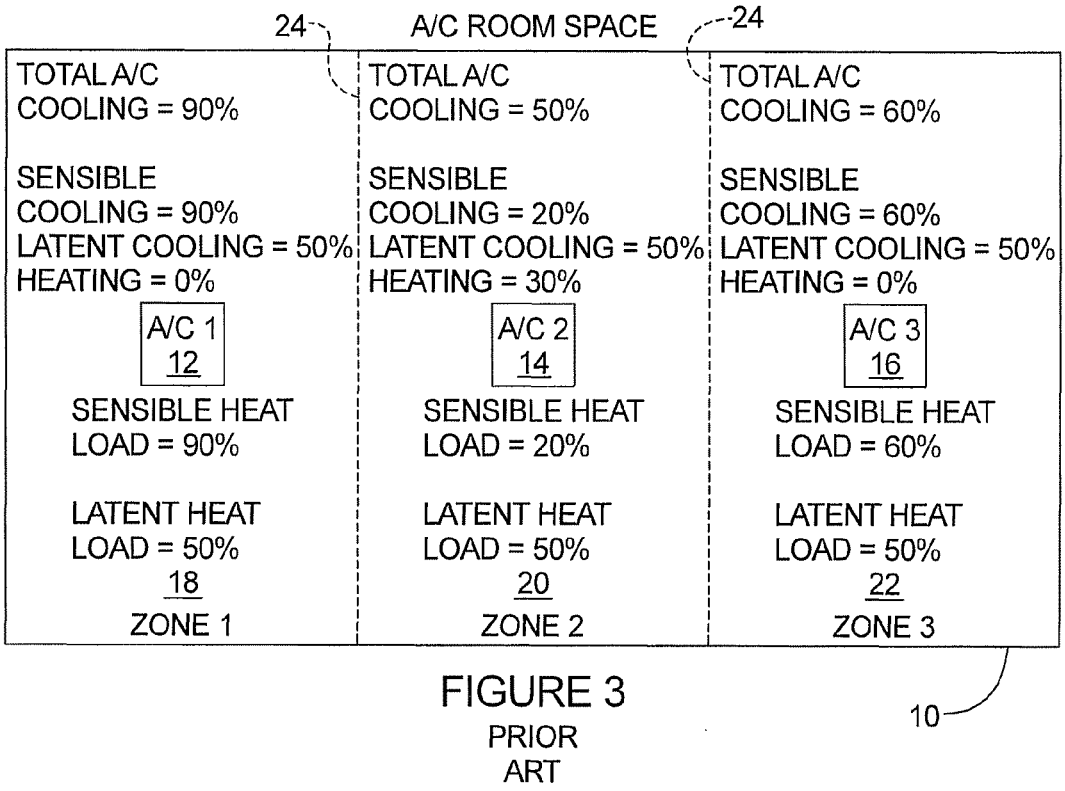
FIGURE 3 PRIOR ART
FIG. 3 is a block diagram of a prior art air conditioning system illustrating the conventional method for performing temperature and humidity control of various zones of a room, and further illustrating how this can lead to inefficient use of the A/C units by requiring one or more of the A/C units that does not have adequate sensible heat load to handle its share of latent heat load.
Figure 4:
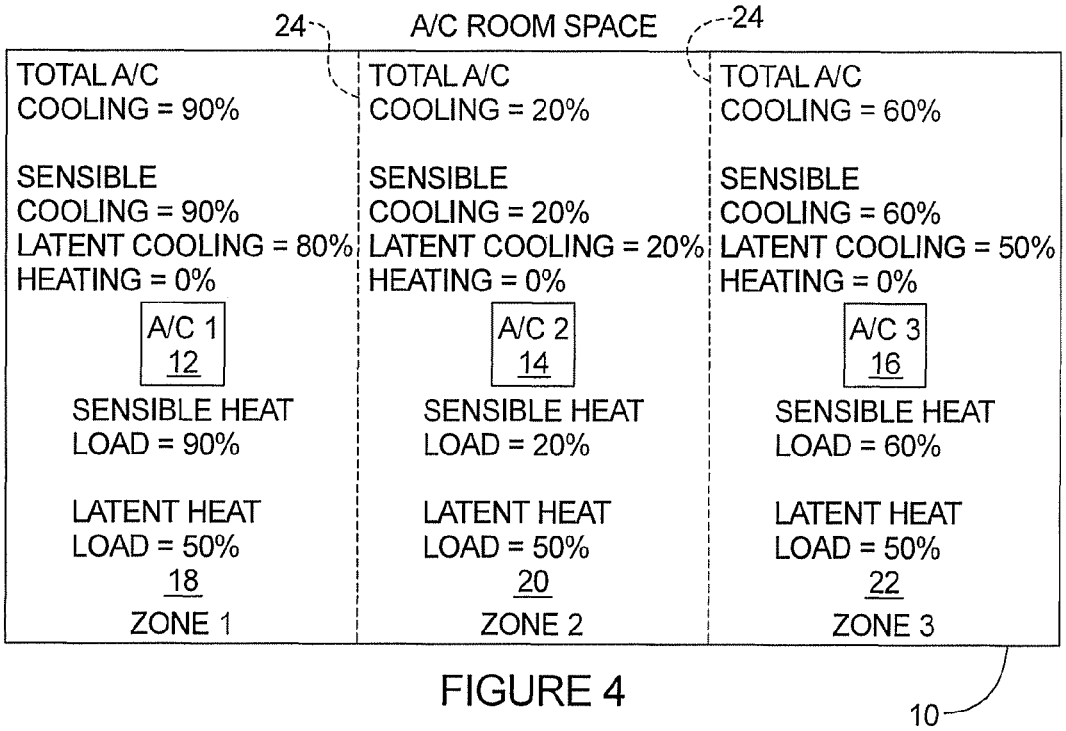
FIG. 4 is a block diagram of one embodiment of an air conditioning system in accordance with the present disclosure illustrating how the latent heat removal load may be distributed to limit the latent heat removal load being handled by A/C unit 2, while increasing the latent heat removal load on A/C unit 1, so that all of the A/C units are operating efficiently.

In accordance with an aspect of the present disclosure, rather than having each A/C unit independently provide latent heat removal for its respective zone, the A/C unit(s) that provides the most energy efficient mode of operation for the overall system is selected and used for latent heat removal for all zones. FIG. 4 illustrates this improved method of performing temperature and humidity control for the same conditions as the previous standard control method example shown in FIG. 3. In accordance with one implementation of the present method, A/C unit 14 is "forced" (that is, controlled) to operate in an efficient mode by limiting its latent heat removal to 20% rather than allowing it to respond normally to the level of moisture in the room. A/C unit 12 is also "forced" (that is, controlled) to assume the remaining proportion (30%) of latent heat removal that A/C unit 14 would otherwise be required to perform. That is, this remaining proportion of latent heat removal that is required is re-allocated from A/C unit 14 to the A/C unit 12. But since the sensible heat load on A/C unit 12 is still greater (i.e., 90%) than the total latent heat removal (i.e., 80%) by the first A/C unit 12 being assumed, heating is not required to maintain temperature control in the respective zone (Zone 1) of A/C unit 12, and A/C unit 12 thus still operates in an efficient mode. Also, since the moisture in the room distributes evenly, the system will still maintain overall room humidity control in all three zones 18, 20 and 22. The total latent heat removal by the combined A/C units 12, 14 and 16 is equal to the total latent heat removal of the previous standard control mode example shown in FIG. 3, but the overall system efficiency is improved since no one A/C unit 12, 14 or 16 is required to operate in a heating mode in order to maintain temperature control in its respective zone.

It should be understood that the remaining proportion of the latent heat load re-allocated from A/C unit 14 to A/C unit 12 could, in the example of FIG. 4, be re-allocated to both A/C unit 12 and A/C unit 16. But the re-allocation to A/C unit 16 should be no more than 10% of the latent heat load in the room so that the new (i.e., total) latent head load on A/C unit 16 is no more than the sensible heat load of 60% on A/C unit 16. In this example, the new latent head load on A/C 16 would be 60%, which would be acceptable, and therefore not necessitate any heating.

Figure 5:
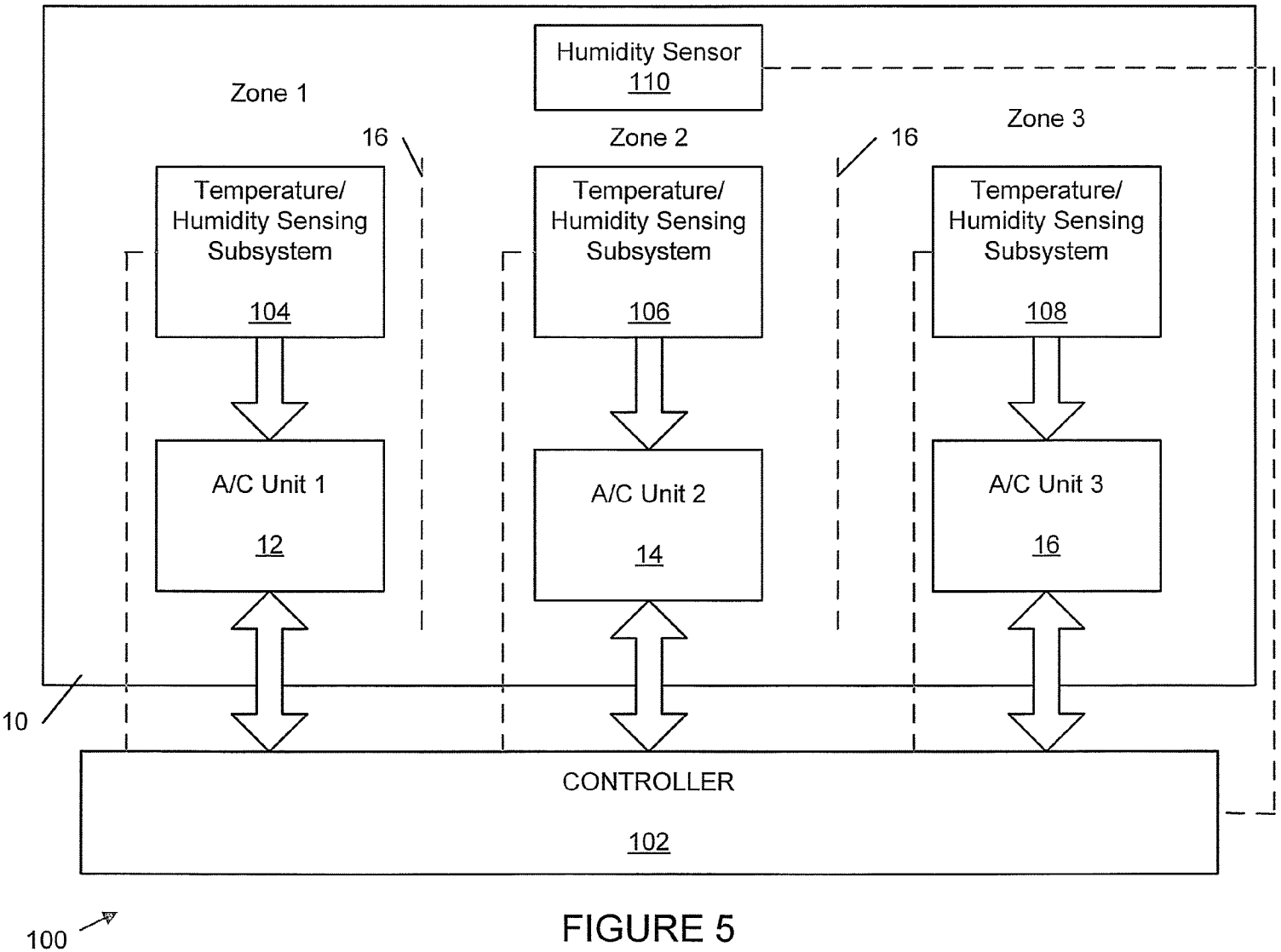
FIG. 5 is a more detailed block diagram of the system of FIG. 4.

Referring now to FIG. 5, an A/C system 100 is shown in accordance with one embodiment of the present disclosure. In this embodiment the three A/C units 12, 14 and 16 are disposed within the room 10 and each is in communication with a controller 102. Each A/C unit 12, 14 and 16 is further in communication with an associated temperature/humidity sensing subsystem 104, 106 and 108, respectively, that senses the temperature and humidity of the air in its associated zone. Alternatively, a single humidity sensor 110 may be used in the room 10, since moisture will be distributed evenly throughout the room.

The controller 102 may be a general purpose computer, a programmable controller or any other form of suitable control system. The controller 102 receives temperature and humidity information from each subsystem 104, 106 and 108 (or humidity information from sensor 110) for each zone. The controller 102 also receives information from each A/C unit 12, 14 and 16 concerning the sensible heat load and latent heat load being handled by each A/C unit 12, 14 and 16. The controller 102 determines which A/C unit 12, 14 or 16 is able to handle additional latent heat load and distributes the additional latent heat load to such unit. It is possible that the controller 102 may determine that the additional latent heat load may be distributed between two of the A/C units 12, 14 or 16, rather than just to a single one of the A/C units, and may so distribute portions of the additional latent heat load to the selected A/C units so that the latent heat load of each of the two A/C units does not exceed the sensible heat load of the two A/C units. It is also possible that the controller 102 may determine that one or more of the A/C units 12, 14 or 16, for example A/C unit 12, is operating inefficiently because of having a higher latent heat loading than sensible heat loading. In this instance the controller 102 would operate to reduce or limit the total latent heat load being handled by A/C unit 12 so that its latent heat removal load does not exceed its sensible heat removal load. Thus, in an effort to distribute the additional latent heat load most efficiently between the A/C units 12, 14 and 16, the controller 102 may reduce or limit the latent heat loading on one or more A/C units 12, 14 or 16 while increasing the latent heat loading on one or more other A/C units.

Figure 6:
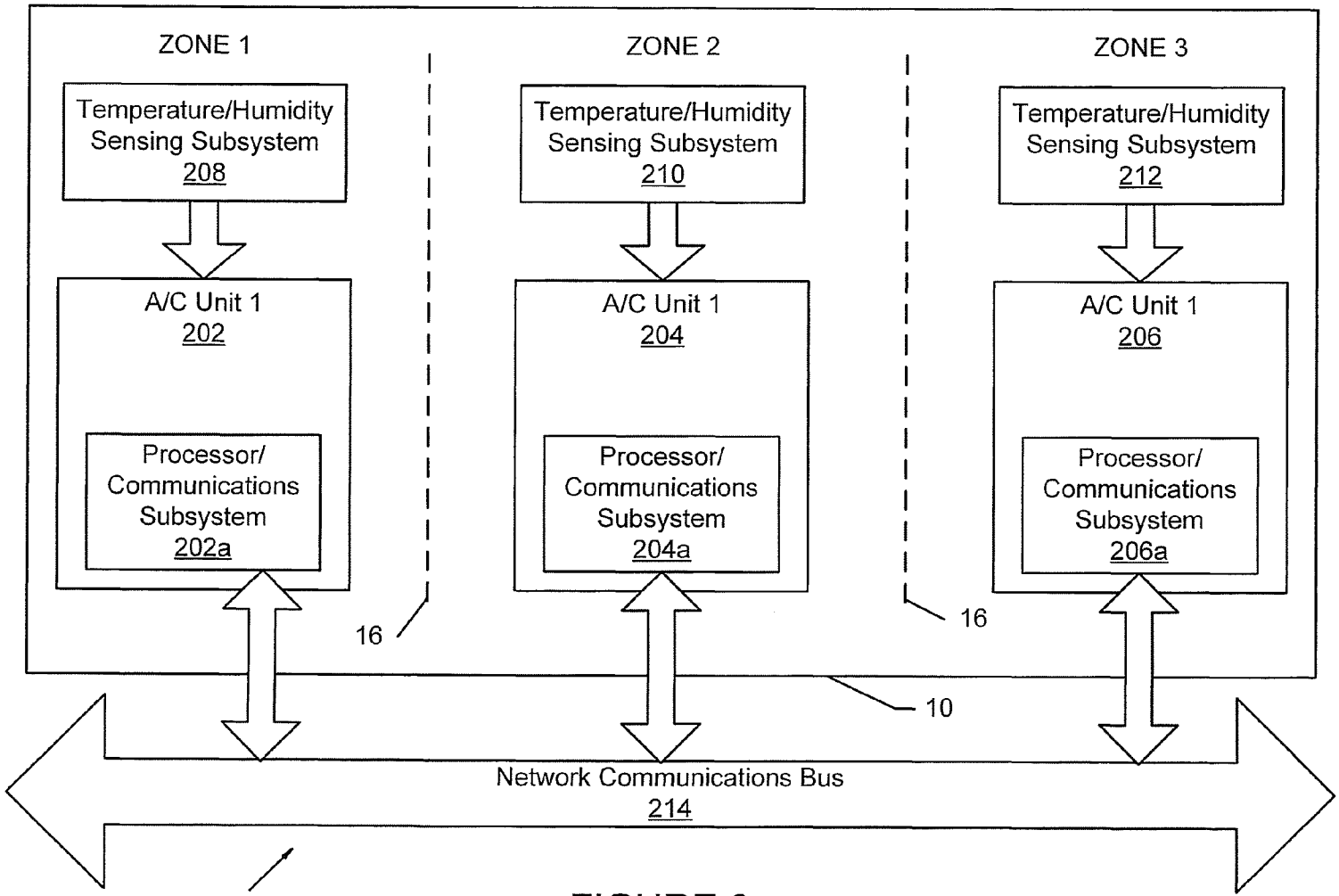
FIG. 6 is a view of another embodiment of the present disclosure in which each A/C unit includes its own processor and communications components, and communicates with the other A/C units via a network bus.

Referring now to FIG. 6, an A/C system 200 in accordance with another embodiment of the present disclosure is shown.

The system 200 includes three A/C units 202, 204 and 206 that each includes a processor/communications subsystem 202*a*, 204*a* and 206*a*, respectively. Temperature/humidity sensing subsystems 208, 210 and 212 are in communication with the A/C units 202, 204 and 206, respectively, within each of the three zones. Each of the processor/communications subsystems 202*a*, 204*a* and 206*a* are in communication with a network communications bus 214 to enable communications between the components 202*a*, 204*a* and 206*a*. While the communications bus is shown outside the room 10, it will be appreciated that the communications bus 214 could just as readily be included within the room 10. The communications bus 214 may form a local area network (LAN) or any other communications link that enables communication between the subsystems 202*a*, 204*a* and 206*a*. The principal difference then is that no external controller is required, since each of the A/C units 202, 204 and 206 includes its own processor/communications subsystem. The method of operation of the system 200 is otherwise the same as for system 100. The processor/communication subsystems 202*a*, 204*a* and 206*a* communicate to one another when they have available latent cooling capacity and accept additional latent heat loading under such circumstances, but only to the extent that the percentage of total latent heat cooling that they each assume does not exceed the percentage of sensible heat loading that each is experiencing.

The systems 100 and 200 further operate to continuously monitor and control the latent heat load balancing between the various A/C units in real time. This ensures that should temperature conditions in any one zone of the room 10 change, that such a condition will be quickly detected and the above-described latent heat load balancing will be re-performed to adjust the latent heat load on each of the A/C units.

Figure 7:
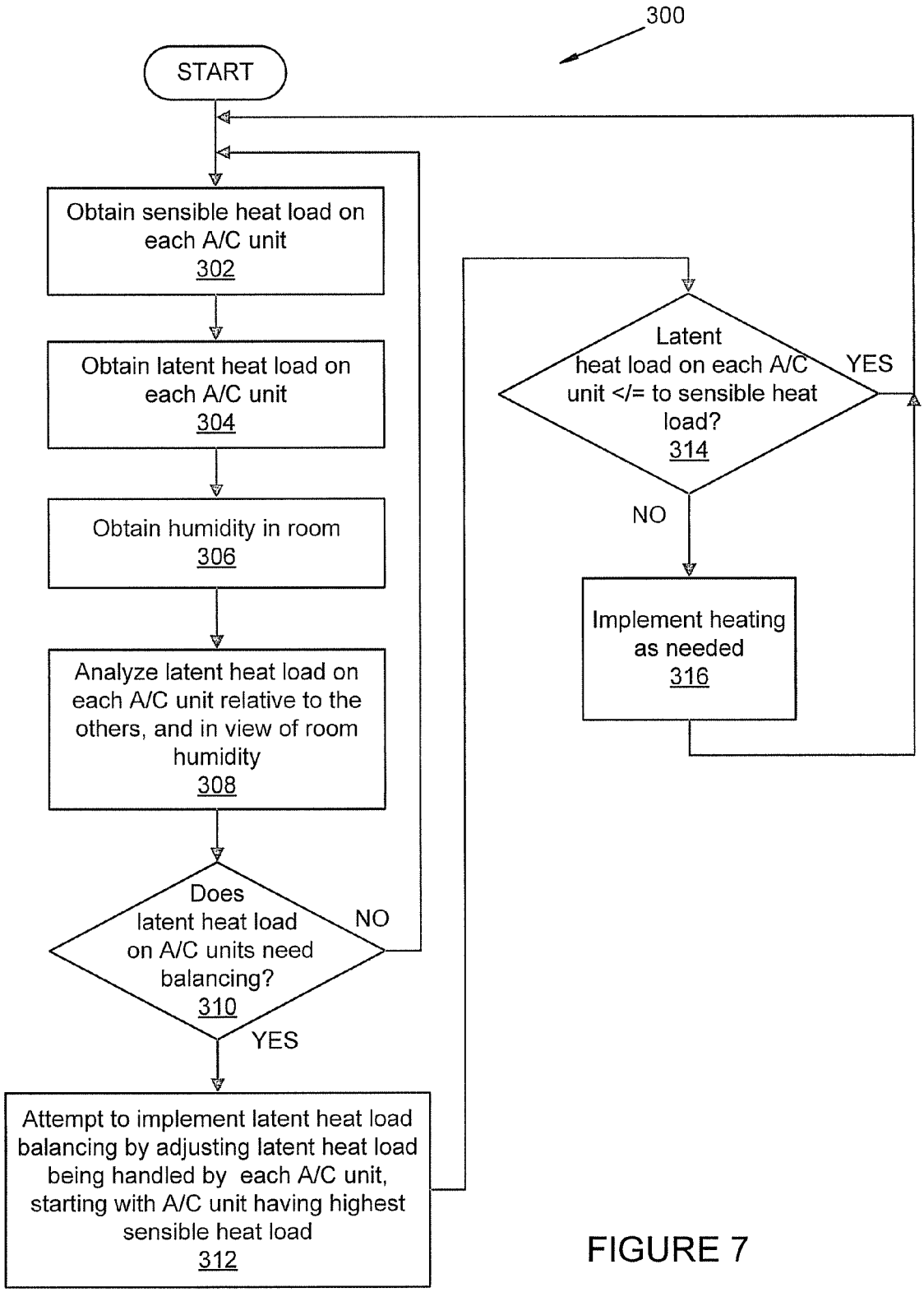
FIG. 7 is a flowchart of operations that may be performed by the system of the present disclosure in distributing the latent heat removal load as needed between various A/C units to achieve efficient operation of the overall system.

Referring to FIG. 7, a flowchart 300 is shown setting forth basic operations performed by the systems 100 or 200. For convenience, reference to specific components of the A/C system 100 will be made when describing the operations of flowchart 300, but it will be appreciated that the same or similar operations may be performed by the components of A/C system 200. At operation 302 the sensible heat load being handled by each A/C unit 12, 14 and 16 is obtained or determined. At operation 304 the latent heat load on each A/C unit 12, 14 and 16 is obtained or determined. At operation 306 the humidity in the room 10 is obtained or determined. At operation 308, the controller 102 may analyze the latent heat load on each A/C unit 12, 14 and 16 relative to the other A/C units, and in view of the humidity in the room 10. At operation 310, the controller 102 determines if the latent heat load on the A/C units 12, 14 and 16 needs balancing to control the humidity in the room 10. If the answer at operation 310 is "No", then a jump is made back to operation 302, and operations 302 through 310 may be repeated. If the answer at operation 310 is "Yes", then the controller 102 may attempt to implement latent heat load balancing by adjusting the latent heat load on each A/C unit 12, 14 or 16, starting with the A/C unit having the highest sensible heat load, as indicated at operation 312.

At operation 314 the controller 102 determines if the latent heat load being handled by each A/C unit 12, 14 and 16 is less than or equal to the sensible heat load being handled by each A/C unit. If the answer to this inquiry is "Yes", then a jump may be made to operation 302, and operations 302-310 repeated. If the answer at operation 314 is "No", then the controller may control a heater (not shown) to implement additional heating as needed, as indicated at operation 316.

In the various embodiments, it will thus be appreciated that the latent heat load experienced by any one or more of the A/C units may be either increased or limited as needed to balance the latent heat load handled by each of the A/C units.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

What is claimed is:

1. An air conditioning (A/C) system comprising:

a plurality of air conditioning units disposed in different zones of an open area that each operate to cool said different zones;

a humidity sensor for sensing the humidity in said area; and a controller adapted to analyze a sensible heat load being experienced by each of said air conditioning units and to control a latent heat removal being performed by each said air conditioning unit such that a percentage of latent heat removal performed by each said air conditioning unit does not exceed a percentage of sensible heat removal being performed by each said air conditioning unit.

2. The system of claim 1, wherein said controller is adapted to reduce a latent heat removal load on least one of said air conditioning units while increasing a latent heat removal load on a different one of said air conditioning units.

3. The system of claim 1, wherein each said air conditioning unit is in communication with a temperature sensing system located in its associated said zone.

4. The system of claim 1, wherein said controller comprises a programmable controller.

5. The system of claim 1, wherein said controller is adapted to determine a distribution of additional latent cooling load between two different ones of said air conditioning units without exceeding said percentage of sensible heat removal being performed by said two different ones of said air conditioning units.

6. The system of claim 1, wherein said controller comprises a computer.

7. An air conditioning (A/C) system comprising:

a first air conditioning unit disposed in a first zone of an open area;

a second air conditioning unit disposed in a second zone of said open area, where the second zone is different from the first zone;

a first system for sensing temperature in said first zone;

a second system for sensing temperature in said second zone;

a humidity sensing system for sensing a humidity in said open area;

a controller for receiving information concerning a sensible heat load and a latent heat load being handled by each of said first and second air conditioning units, determining which one of said air conditioning units is able to accommodate additional latent heat removal without exceeding a percentage of sensible heat removal being performed by each said air conditioning unit, and controlling said one of said air conditioning units to provide a percentage of increased latent heat removal without causing a total percentage of latent heat removal loading on said one air conditioning unit to exceed said percentage of sensible heat removal being performed by said one air conditioning unit.

8. The system of claim 7, wherein said controller is adapted to reduce a latent heat removal load by one of said air conditioning units while increasing a latent heat removal load for the other one of said air conditioning units.

9. The system of claim 7, further comprising a third air conditioning unit, and where said controller is adapted to determine how said additional latent heat removal may be distributed between two of said first, second and third air conditioning units without causing a total latent heat removal load percentage being performed by said two air conditioning units to exceed said percentage of sensible heat removal being performed by each of said two air conditioning units.

10. The system of claim 7, wherein said controller comprises a programmable controller.

11. The system of claim 7, wherein said controller comprises a computer.

12. The system of claim 7, wherein said controller continuously monitors said sensible heat removal being performed by each of said air conditioning units and further adjusts a latent heat removal load for each said air conditioning unit in response to changes in a sensible heat load of any one of said air conditioning units.

13. An air conditioning (A/C) system comprising:

a first air conditioning unit disposed in a first zone of an open area;

a second air conditioning unit disposed in a second zone of said open area, where the second zone is different from the first zone;

a third air conditioning unit disposed in a third zone of open area, where the third zone is different from the first and second zones;

a first system for sensing temperature in said first zone;

a second system for sensing temperature in said second zone;

a third system for sensing temperature in said third zone;

a humidity sensing system for sensing a humidity in said open area;

a controller in communication with each of said first, second and third air conditioning units and adapted to monitor a sensible heat removal load and a latent heat removal load being experienced by each said air conditioning unit; and said controller further adapted to determine which one or more of said air conditioning units is able to accommodate a portion of an additional latent heat removal load without having its percentage of total latent heat removal exceed a percentage of sensible heat removal being performed by each said air conditioning unit, and distributing said additional latent heat load to selected ones of said air conditioning units in accordance with available latent heat cooling capacity of selected ones of said air conditioning units.

14. The system of claim 13, wherein each of said first, second and third systems includes a humidity sensing capability.

15. The system of claim 13, wherein said controller comprises a programmable controller.

16. The system of claim 13, wherein said controller comprises a general purpose computer.

17. A method for controlling temperature and humidity in an open area having a plurality of zones, the method comprising:

disposing an air conditioning unit in each of said zones;

sensing a temperature in each of said zones;

sensing a humidity in said area;

determining a sensible heat removal load being experienced by each said air conditioning unit; and balancing a removal of latent heat within said area by said air conditioning units such that a percentage of latent heat removal load being experienced by each said air conditioning unit does not exceed a percentage of its said sensible heat removal load.

18. The method of claim 17, wherein said balancing a removal of latent heat within said area comprises limiting a percentage of latent heat removal load being experienced by a selected one or more of said air conditioning units.

19. The method of claim 17, wherein said balancing a removal of latent heat within said area by said air conditioning units comprises reducing a percentage of latent heat removal being performed by one of said air conditioning units and increasing a percentage of latent heat removal by a different one of said air conditioning units.

20. The method of claim 17, wherein balancing a removal of latent heat within said area by said air conditioning units comprises using a controller to communicate with said air conditioning units and to control said percentage of latent heat removal being experienced by each of said air conditioning units.

21. The method of claim 17, wherein balancing a removal of latent heat within said area by said air conditioning units comprises a communications bus to communicate with a processor/communications subsystem of each said air conditioning unit, such that said processor/communications subsystems may cooperatively control their said percentages of latent heat removal.

* * * * *